United States Patent [19]

Ziegenberg et al.

[11] Patent Number: 4,868,882

[45] Date of Patent: Sep. 19, 1989

[54] LOUDSPEAKER

[75] Inventors: Alfred Ziegenberg, Villingen-Schwenningen-Marbac; Edmund Schiessle, Schorndorf, both of Fed. Rep. of Germany

[73] Assignee: Daimler-Benz AG, Stuttgart, Fed. Rep. of Germany

[21] Appl. No.: 242,804

[22] Filed: Sep. 12, 1988

[30] Foreign Application Priority Data

Sep. 10, 1987 [DE] Fed. Rep. of Germany ..... 3730305

[51] Int. Cl.[4] ..... H04R 9/02

[52] U.S. Cl. ..... 381/200

[58] Field of Search ..... 381/192, 194, 193, 199, 381/200, 201, 202, 203, 204

[56] References Cited

FOREIGN PATENT DOCUMENTS 0009197 1/1982 Japan ..... 381/194

0148500 8/1984 Japan ..... 381/201

*Primary Examiner*—Forester W. Isen

*Attorney, Agent, or Firm*—Barnes & Thornburg

[57] ABSTRACT

A loudspeaker is disclosed with a diaphragm and an annular moving coil fastened to the diaphragm. An annular permanent-magnet system is arranged concentrically relative to the moving coil and is fastened to a support. To obtain a high-power and extremely slim system, the moving coil surrounds the permanent-magnet system with only a small air gap and, on its outer surface, carries a thin-walled annular core of amorphous metal. The permanent-magnet system consists of two permanent-magnet rings spaced from one another by means of a soft-mangetic annular intermediate disc and having like poles facing one another.

19 Claims, 2 Drawing Sheets

LOUDSPEAKER

BACKGROUND & SUMMARY OF THE INVENTION

The invention relates to a loudspeaker of the type having an annular permanent magnet system with an annular moving coil connected to a loudspeader diaphragm:

A loudspeaker of the particular generic type which makes it possible to achieve a relatively slim design is already known (German Periodical: Funkschau [Radio View] 1978, No. 1, pages 21 (63) to 24 (66)). This so-called "Manger" sound converter has a relatively large and therefore heavy annular permanent magnet which is arranged on a support for the magnetic return and within which moves the moving coil fastened to the plane round diaphragm disc and centered relative to the permanent magnet by means of a restoring force, albeit only slight. Furthermore, the diaphragm is a complex and therefore a relatively expensive multi-layer diaphragm.

An object of the invention is to design a loudspeaker of the particular generic type, so that, whilst at the same time ensuring a comparable sound quality, it has a simpler and more cost-effective construction, a smaller constructional volume, especially a slimmer design, and a lower weight.

In a loudspeaker of the particular generic type, this object is achieved by providing the moving coil as an annular coil which carries a thin walled annular core of amorphous metal at its outer surface and which surrounds the permanent magnet system which is composed of two permanent magnet rings spaced from one another by means of a soft-magnetic annular intermediate disk and with like poles facing one another.

Other objects, advantages and novel features of the present invention will become apparent from the following detailed description of the invention when considered in conjunction with the accompanying drawings.

DETAILED DESCRIPTION OF THE DRAWINGS

Figure 1:
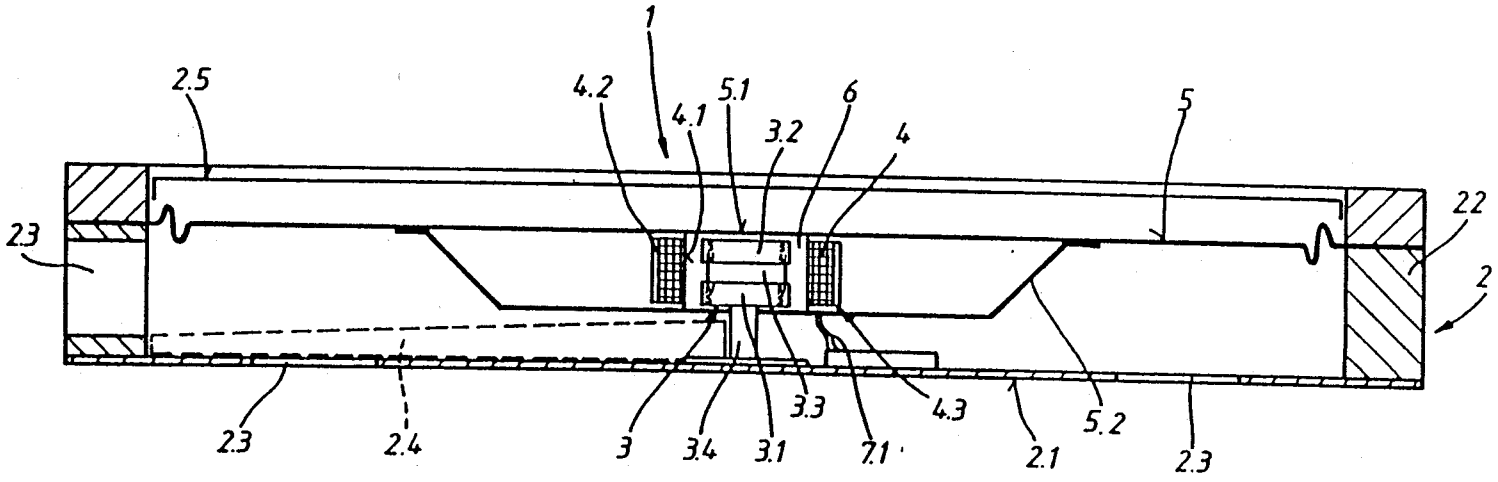
FIG. 1 is a schematic sectional view which shows a first exemplary embodiment of a loudspeaker constructed according to the invention.
Figure 1A:
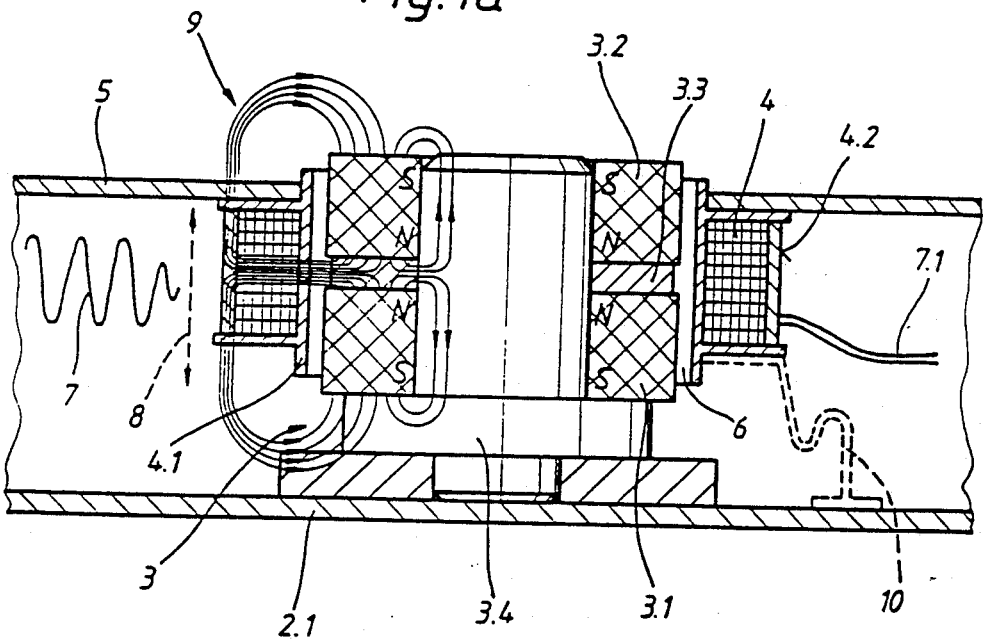
FIG. 1*a* shows, on an enlarged scale, the permanent-magnet system and the moving coil, with the magnetic flux represented, of the FIG. 1 loudspeaker.

The Loudspeaker 1 illustrated in FIGS. 1 and 1a consists essentially of a support 2, a permanent-magnet system 3, a moving coil 4 and a diaphragm 5. The support 2 consisting of a non-magnetic material has a baseplate 2.1 and a frame 2.2., in which the plane diaphragm 5 having a circular or oval form is clamped. The moving coil 4 is fastened to the diaphragm 5, concentrically relative to its center 5.1, via an insulating coil form 4.1. On its outer surface, the moving coil 4 carries a thin-walled annular core 4.2 consisting of a high-permeability amorphous metal foil of a thickness of approximately 30 microns having a high specific electrical resistance and a very low magnetostriction. The permanent-magnet system 3 extends into the moving coil 4 or the coil form 4.1 and, on a preferably non-magnetic or else soft-magnetic bolt 3.4 fastened to the baseplate 2.1, has two permanent-magnet rings 3.1 and 3.2 spaced from one another by means of a soft-magnetic annular intermediate disc 3.3 preferably consisting of layered amorphous metal-foil discs, and the like poles (N-N) of the permanent-magnet rings consisting of a cobalt/samarium alloy and face one another. At the same time, the moving coil 4 surrounds the permanent-magnet rings 3.1, 3.2 with only a small air gap 6 and is arranged approximately centrally relative to these. The thickness of the annular intermediate disc 3.3 amounts to approximately 1 mm, and the diameter of a permanent-magnet ring is approximately 12 mm and its thickness approximately 3.4 mm. The site of the air gap 6 is represented in the drawings.

Now when the moving coil 4 receives a low-frequency signal voltage 7 via the terminals 7.1, as shown diagrammatically in FIG. 1a, the diaphragm 5 moves at a low-frequency rhythm 8 as a result of the magnetic interaction between permanent-magnet system 3 and excited moving coil 4 and thus converts the low-frequency coil current into a proportional low-frequency acoustic signal. As is clear, at the same time, the flux lines 9 starting from the two north poles of the permanent-magnet rings 3.1, 3.2 pass, bunched by the annular intermediate disc 3.3, through the moving coil 4 approximately perpendicularly and the magnetic circuit is closed as a result of renewed bunching of the flux lines in the amorphous annular core 4.2, via this, back to the south poles. As a result of the bunching of the flux lines 9 in the annular intermediate disc 3.3 on the one hand and the bunching in the amorphous annular core 4.2 on the other hand (suction effect), a high concentration of the magnetic flux through the moving coil is obtained, thereby achieving an increase in lift (power amplification) for the loudspeaker.

Furthermore, the use and special arrangement of the permament-magnet rings and of the amorphous annular core around the moving coil make it possible to install a small light-weight moving coil which need not be centered exactly and which is therefore contactless. The simple and light single-layer diaphragm and the small and light moving coil, without centering forces, make it possible to obtain short build-up times and consequently also, where bass is concerned, a distortion-free sound reproduction.

In addition to these advantages in terms of sound, the loudspeaker according to the invention, because of its light, small (constructional height approximately 15 mm), simple and therefore cost-effective design, also has substantial advantages in terms of construction, as a result of which it is especially suitable for the electro-acoustic information technique in a motor vehicle.

As is also evident from FIG. 1, there can, if necessary, to achieve an ideal frequency response (bass notes), be at least one further auxiliary diaphragm 5.2 which extends horizontally from a region within the diaphragm 5 to the free end 4.3 of the moving coil 4 and which is fastened to the diaphragm 5 on the one hand and to the coil form 4.1 of the moving coil 4 on the other hand.

Since the loudspeaker itself requires no housing, several sound transmission orifices 2.3 can be provided in the baseplate 2.1 and/or in the frame 2.2 in each case, depending on the desired radiation direction. When there is only front and side radiation, several sound guide parts 2.4 of appropriate form (represented by broken lines in FIG. 1) which extend from the middle region up to the sound transmission orifices 2.3 can be arranged on the baseplate 2.1 as an additional measure.

To protect the loudspeaker and the diaphragm 5 against mechanical damage, the diaphragm 5 is covered by a screen 2.5 fastened to the frame 2.2.

Whilst FIG. 1 shows the diaphragm 5 as being clamped in the frame 2.2 of the support 2, it is also contemplated not to clamp the diaphragm 5, so that with its outer contour it only reaches near to the frame, but does not touch this. In this case, the diaphragm 5 and, together with it, the moving coil 4 are then fastened to the base plate 2.1 of the support 2 via a sleeve-like spring means 10, shown in the right-hand part of FIG. 1*a*. Such a fastening of the diaphragm to the support is expedient when the diaphragm 5 has a polygonal, especially rectangular form, since possible form-related distortions of the diaphragm, such as can occur during clamping, then cannot arise.

Figure 2:
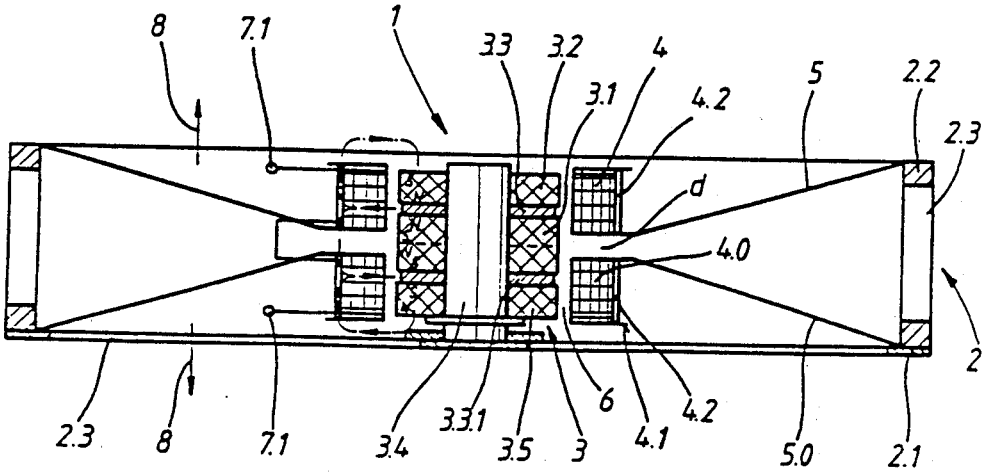
FIG. 2 is a schematic sectional view which shows a further exemplary embodiment of a loudspeaker constructed according to this invention.

FIG. 2 shows a so-called tandem version of the loudspeaker system 1. On the one hand, the frame 2.2 and, on the other hand, the preferably non-magnetic bolt 3.4 of the permanent-magnet system 3, on which the permanent-magnet rings are arranged, are fastened on a star-shaped baseplate 2.1 formed, for example, by webs and belonging to the support 2. Here, the permanent-magnet system 3 consists of a double arrangement of two permanent-magnet rings 3.2, 3.1 and 3.1, 3.5 respectively, the two inner permanent-magnet rings appropriately being combined to form a permanent magnet 3.1. In this version too, the permanent-magnet rings 3.2, 3.1 are spaced from one another by means of a soft-magnetic annular intermediate disc 3.3, and the permanent-magnet rings 3.1, 3.5 are spaced from one another by means of a soft-magnetic annular intermediate disc 3.3.1. A moving coil 4, 4.0 with an annular core 4.2 of amorphous metal is arranged concentrically respectively both around the permanent-magnet rings 3.2, 3.1 and around the permanent-magnet rings 3.1, 3.5 to form a small air gap 6, the two moving coils 4, 4.0 being electrically connected oppositely in series and being equipped with terminals 7.1

Furthermore, they are arranged at a short distance d from one another, the distance d corresponding approximately to double the movement stroke of a moving coil. On the inner end faces of the moving coils, a funnel-shaped diaphragm is fastened at each of them, namely the diaphragm 5 to the moving coil 4 and the diaphragm 5.0 to the moving coil 4.0, the diaphragms 5, 5.0 being clamped in the frame 2.2 of the support 2 on the outside.

Now when the two moving coils 4, 4.0 receive a low-frequency signal voltage via the terminals 7.1, the diaphragms 5, 5.0 move at a low-frequency rhythm 8 as a result of the magnetic interaction between permanent-magnet system 3 and excited moving coils, specifically because of the opposite connection of the moving coils and the special pole arrangement of the permanent-magnet rings in opposite directions, and thus convert the low-frequency coil current into proportional low-frequency acoustic signals. As is clear, the pole arrangement is such that the north poles of the permanent-magnet rings 3.2, 3.1 face one another and the south poles of the permanent-magnet rings 3.1, 3.5 face one another. In this version too, sound transmission orifices 2.3 are provided both in the frame 2.2 and in the star-shaped baseplate 2.1, so that the loudspeaker can radiate in all directions.

Thus, by means of the loudspeaker according to the invention, it is possible to achieve, in particular, an extremely slim design, whilst at the same time ensuring a high sound quality, so that it is ideally suited especially as a full-range loudspeaker for use in motor vehicles, but also in entertainment electronics.

In certain preferred embodiments, the permanent magnet rings consist of an NdFe/B alloy.

In certain preferred embodiments, the diaphragm has a rectangular form.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. Loudspeaker with a diaphragm and an annular moving coil fastened to the diaphragm concentrically relative to its center and a coil axis of which extends perpendicularly relative to the diaphragm, and with an annular permanent-magnet system arranged concentrically relative to the moving coil and fastened to a support, wherein the moving coil surrounds the permanent-magnet system with only a small air gap and carries on its outer surface a thin-walled annular core of amorphous metal, and wherein the permanent-magnet system comprises two permanent-magnet rings having like poles facing one another, said permanent magnet rings being spaced from one another by means of a soft-magnetic annular intermediate disc.

2. Loudspeaker according to claim 1, wherein the annular core consists of a high-permeability amorphous metal foil having a high specific electrical resistance and a very low magnetostriction.

3. Loud speaker according to claim 1, wherein the soft-magnetic annular intermediate disc consists of amorphous metal.

4. Loudspeaker according to claim 1, wherein the permanent-magnet rings consists of one of cobalt-/samarium alloy, and a NdFe/B alloy.

5. Loudspeaker according to claim 1, wherein the diaphragm is clamped in a frame of a non-magnetic support.

6. Loudspeaker according to claim 1, wherein the diaphragm and, together with it, the moving coil are fastened to a baseplate of a non-magnetic support via spring means.

7. Loudspeaker according to claim 5, wherein the diaphragm has a circular or oval form.

8. Loudspeaker according to claim 6, wherein the diaphragm has a rectangular form.

9. Loudspeaker according to claim 1, wherein the diaphragm is made planar.

10. Loudspeaker according to claim 1, wherein the diaphragm is made funnel-shaped.

11. Loudspeaker according to claim 1, wherein at least one auxiliary diaphragm extends horizontally from a region within the diaphragm to the free end of the moving coil and is fastened to the diaphragm on the one hand and to the moving coil on the other hand.

12. Loudspeaker according to claim 1, further comprising a non-magnetic support, consisting of a frame and a baseplate, there being several sound transmission orifices in at least one of these parts.

13. Loudspeaker according to claim 12, further comprising sound guide parts of which extend from a middle region up to the sound transmission orifices of the frame are arranged on a side of the baseplate of the support which faces the diaphragm.

14. Loudspeaker according to claim 1, wherein the diaphragm is covered by a screen fastened to the support.

15. Loudspeaker according to claim 1, wherein a further permanent-magnet ring with a facing like pole is assigned to one of the two permanent-magnet rings and being spaced from it by means of a further soft-magnetic annular intermediate disc, the moving coil surrounding the permanent-magnet rings and a further moving coil surrounded with an annular core of amorphous metal surrounding the permanent-magnet rings with only a small air gap, and furthermore the two moving coils being electrically connected opposite in series to form a composite moving coil and being arranged at a short distance (d) from one another, and wherein the diaphragm is funnel-shaped on the one hand, and is fastened to the composite coil and on the other hand, a like further funnel-shaped diaphragm is fastened to the composite moving coil, and is clamped in the frame.

16. Loudspeaker according to claim 12, wherein a further permanent-magnet ring with a facing like pole is assigned to one of the two permanent-magnet rings and being spaced from it by means of a further soft-magnetic annular intermediate disc, the moving coil surrounding the permanent-magnet rings and a further moving coil surrounded with an annular core of amorphous metal surrounding the permanent-magnet rings with only a small air gap, and furthermore the two moving coils being electrically connected oppositely in series to form a composite moving coil and being arranged at a short distance (d) from one another, and wherein the diaphragm is funnel-shaped on the one hand, and is fastened to the composite moving coil and on the other hand, a like further funnel-shaped diaphragm is fastened to the composite moving coil, and is clamped in the frame.

17. Loudspeaker according to claim 1, wherein said loudspeaker is a full-range loudspeaker.

18. Loudspeaker according to claim 1, wherein only said two permanent-magnet rings are provided and only said single diaphragm is provided, wherein a single diaphragm loudspeaker is obtained.

19. Loudspeaker according to claim 1, wherein the soft-magnetic annular intermediate disc consists of layered amorphous metal-foil discs.

* * * * *